US009258631B1

(12) United States Patent
Xu et al.

(10) Patent No.: US 9,258,631 B1
(45) Date of Patent: Feb. 9, 2016

(54) MICRO-SPEAKER

(71) Applicants: Yunxia Xu, Shenzhen (CN); Yi Shao, Shenzhen (CN)

(72) Inventors: Yunxia Xu, Shenzhen (CN); Yi Shao, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/525,454

(22) Filed: Oct. 28, 2014

(30) Foreign Application Priority Data

Jul. 18, 2014 (CN) ..... 2014 2 0401753 U

(51) Int. Cl.

| | |
|---|---|
| ***H04R 9/06*** | (2006.01) |
| ***H04R 1/00*** | (2006.01) |
| ***H04R 7/00*** | (2006.01) |
| ***H04R 3/00*** | (2006.01) |
| ***H04R 1/06*** | (2006.01) |
| ***H04R 9/02*** | (2006.01) |

(52) U.S. Cl.
CPC .. *H04R 1/00* (2013.01); *H04R 1/06* (2013.01); *H04R 3/00* (2013.01); *H04R 7/00* (2013.01); *H04R 9/025* (2013.01); *H04R 9/06* (2013.01); *H04R 2400/11* (2013.01); *H04R 2499/11* (2013.01)

(58) Field of Classification Search
CPC ..... H04R 1/00; H04R 1/06; H04R 9/025; H04R 9/04; H04R 9/045; H04R 9/06; H04R 9/10; H04R 2209/024; H04R 2209/041; H04R 2400/03; H04R 2400/11; H04R 2499/11
USPC ..... 381/332, 334, 386, 394, 396, 400, 401, 381/402, 409, 410, 431, 433; 379/433.02, 379/433.05, 438
See application file for complete search history.

(56) References Cited

U.S. PATENT DOCUMENTS

| | | | | |
|---|---|---|---|---|
| 6,404,896 | B1 * | 6/2002 | Yoo | H04R 9/045 381/401 |
| 6,570,993 | B1 * | 5/2003 | Fukuyama | G10K 9/22 340/388.1 |
| 2012/0213398 | A1 * | 8/2012 | Itoh | H04R 9/025 381/334 |

* cited by examiner

*Primary Examiner* — Huyen D Le
(74) *Attorney, Agent, or Firm* — IPro, Inc.; Na Xu

(57) ABSTRACT

A micro-speaker is disclosed. The micro-speaker includes a frame, a magnetic circuit unit in the frame, a diaphragm, and a voice coil connected to the diaphragm. The frame includes a plurality of blocks for positioning the magnetic circuit unit. The voice coil includes a pair of lead wires. The block has an upper surface, a side surface and a bottom surface treated by laser direct structuring process for electrically connecting to the lead wires of the voice coil.

5 Claims, 4 Drawing Sheets

MICRO-SPEAKER

FIELD OF THE INVENTION

The present invention relates to electroacoustic apparatuses, more particularly to a micro-speaker used in an electronic device for converting electrical signals to audible sounds.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of micro-speakers have been developed. An micro-speaker is generally coupled to an audio equipment or an amplifier for use as a large sound producing means for considerably amplifying volume. Alternatively, the micro-speaker may be used as a small sound producing means having a small size and volume.

An electronic device, such as a cellular phone, a camcorder, a PDA, a digital camera, or a notebook computer, provides a space for accommodating a micro-speaker therein. Nowadays, a micro-speaker with high quality audio performance and miniature size is desired.

A typical micro-speaker related to the present disclosure includes a vibration unit having a diaphragm, a magnetic circuit unit having a magnet, and a housing for receiving the vibration unit and the magnetic circuit unit therein. For improving the low frequency sound performance, this kind of micro-speaker generally provides a diaphragm or a magnet having relatively greater weight. Contacts are used for electrically connecting the vibration unit to an external signal source. Greater or heavier magnetic circuit unit will occupy the space inside of the micro-speaker, and for ensuring the space for the magnetic circuit unit, contacts have to be designed smaller and smaller. However, smaller contact cannot provide stable electrical connection. The electrical connection achieved by the contacts can be easily broken during the vibration of the vibration unit.

Accordingly, an improved micro-speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
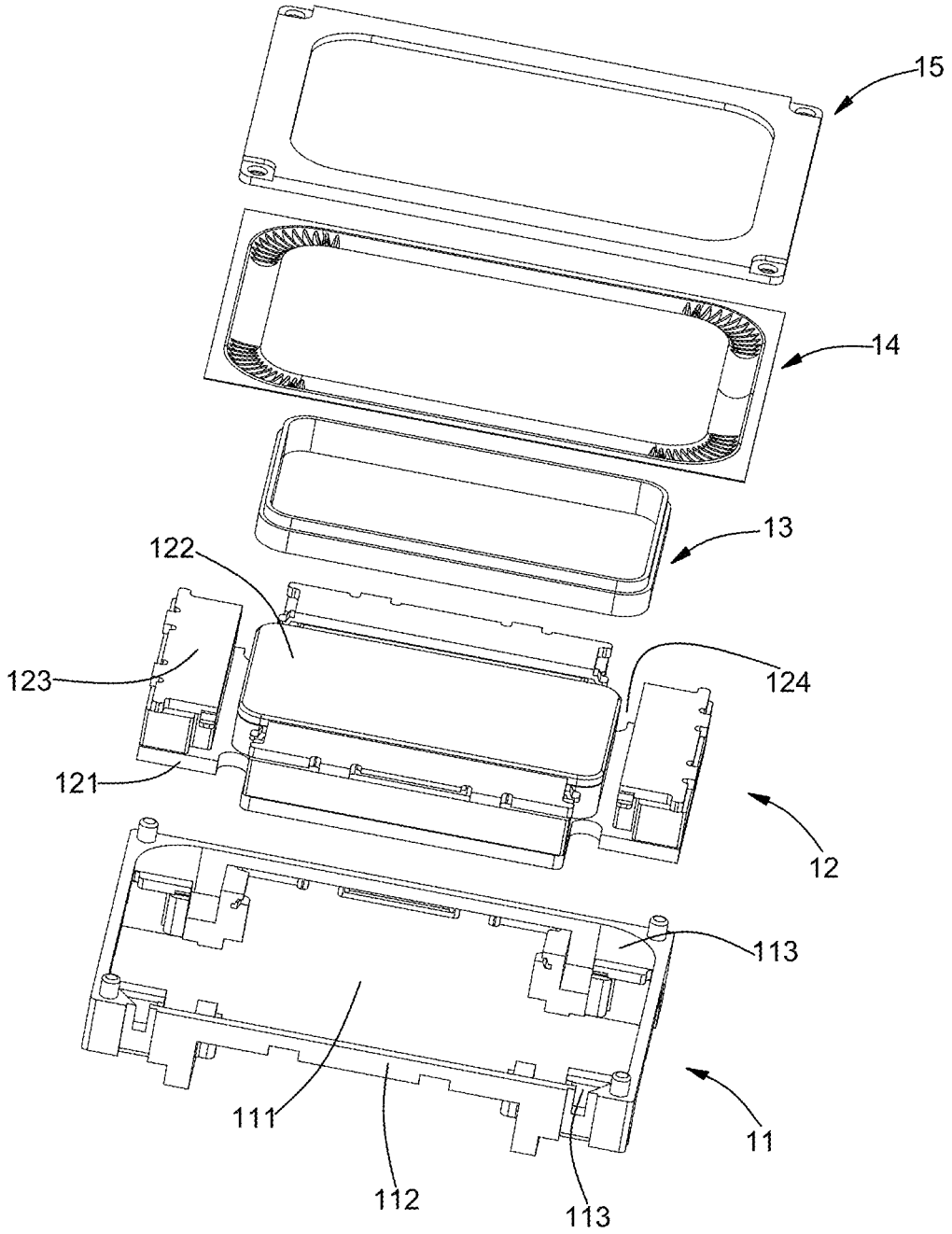
FIG. 1 is an isometric and exploded view of a micro-speaker in accordance with an exemplary embodiment of the present disclosure.

Referring to FIG. 1, a micro-speaker 10 in accordance with a first embodiment of the present disclosure includes a frame 11 made of plastic, a magnetic circuit unit 12, a voice coil 13, a diaphragm 14, and a cover 15. The frame 11 includes a cavity 111 bounded by a sidewall 112 for receiving the magnetic circuit unit 12. The frame 11 further includes a plurality of blocks 113 extending from the sidewall 112 into the cavity 111. The magnetic circuit unit 12 includes a lower plate 121 made of magnetic conductive material, a main magnet 122 positioned on a central portion of the lower plate 121, and a plurality of auxiliary magnets 123 positioned on the lower plate 121 surrounding the main magnet 121 for forming a magnetic gap 124. Optionally, the magnetic circuit unit may include one magnet for forming the magnetic gap.

Figure 2:
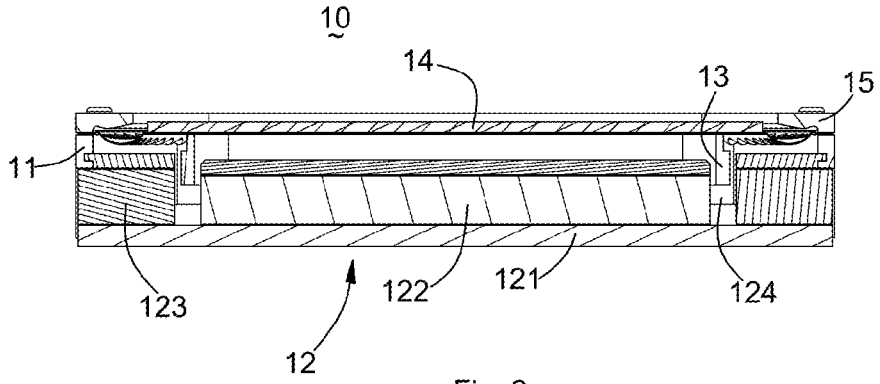
FIG. 2 is an cross-sectional view of the micro-speaker in FIG. 1.
Figure 3:
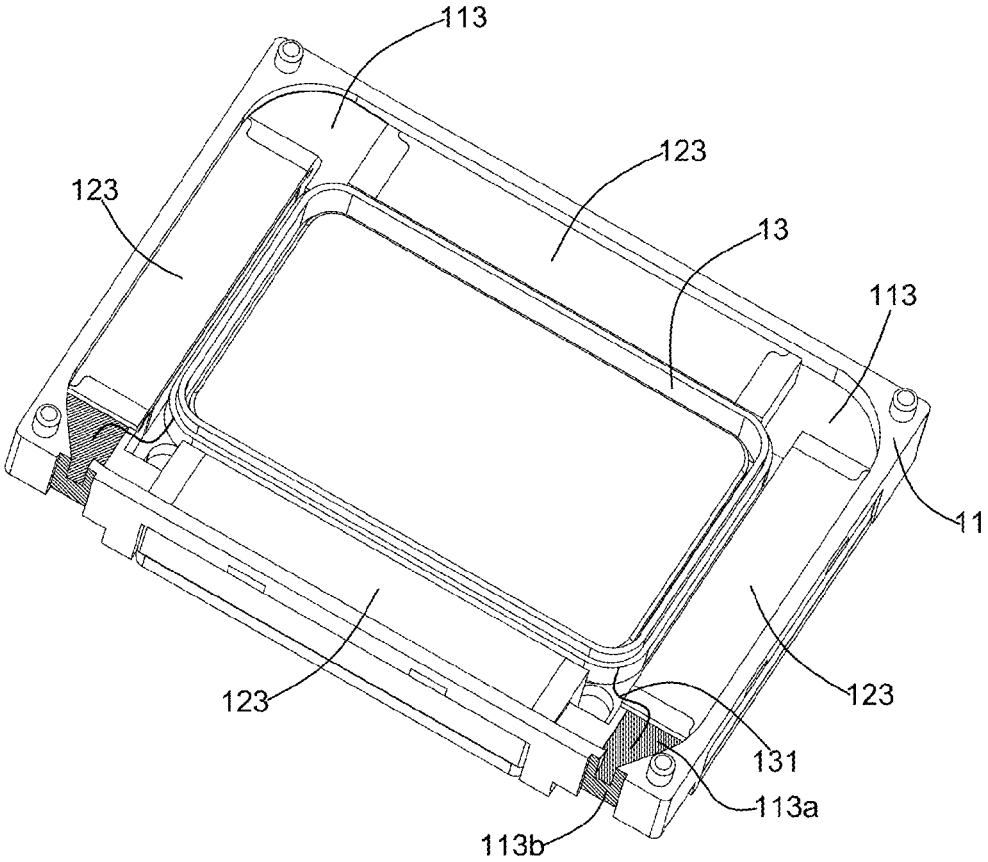
FIG. 3 is an isometric view of the micro-speaker in FIG. 1, but a diaphragm and a cover thereof being removed for clearly showing the inner structure.
Figure 4:
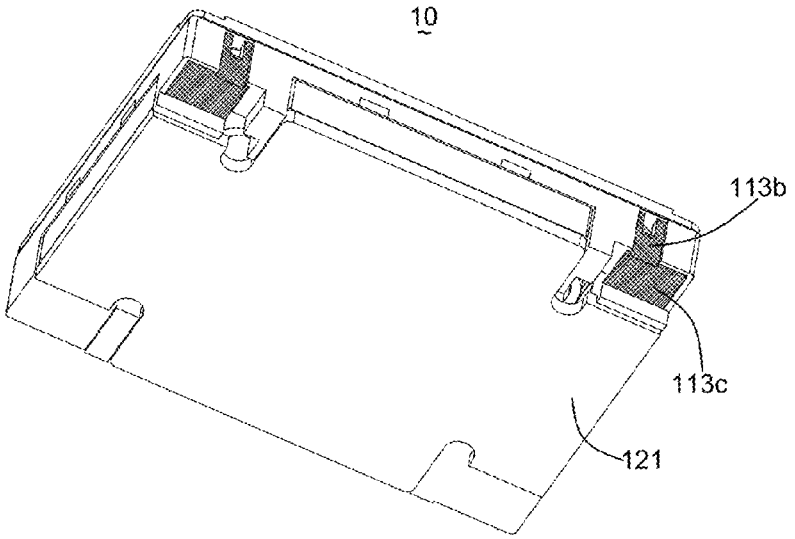
FIG. 4 is an isometric view of the micro-speaker in FIG. 1, from another aspect.

Referring to FIGS. 2-4, when assembled, the magnetic circuit unit 12 is fixed by the blocks 113 of the frame 11. The diaphragm 14 is fixed to the frame 11 by the cover 15, and the voice coil 13 suspends in the magnetic gap 124 with one end thereof connected to a lower surface of the diaphragm 14. When electrified, the voice coil 13 drives the diaphragm 14 to vibrate for producing audible sounds. The blocks 113 locates between two adjacent auxiliary magnets 123 and abuts against the two adjacent auxiliary magnets 123 for positioning the magnetic circuit unit. The block 113 includes an upper surface 113*a*, a side surface 113*b*, and a bottom surface 113*c* (refer to FIG. 4). The frame 11 is made of plastic, but at least the blocks 113 are made of material compatible with LDS process (Laser Direct Structuring Process). The upper surface 113*a*, the side surface 113*b*, and the bottom surface 113*c* are treated by LDS process for performing the ability of conduct electricity. As the upper surface 113*a*, the side surface 113*b*, and the bottom surface 113*c* are in fact one piece covering the surface of the block 113, the upper surface 113*a* is electrically connected to the bottom surface 113*c* via the side surface 113*b*.

The voice coil 13 includes a pair of lead wires 131 electrically connecting to the upper surface 113*a* of the block 113. When mounted to an electrical device, the bottom surface 113*c* is electrically connected to an external circuit, and thus the lead wire 131 is also electrically connected to the external circuit via the block 113. By virtue of the block 113 treated by LDS process, the contacts used in related arts are omitted and the conductive path is achieved by the frame itself. Such, the space for receiving the magnetic circuit unit is ensured because no space is especially provided for the contacts. Optionally, the bottom surface 113*c* is higher than the lower plate 121, i.e., closer to the diaphragm than the lower plate 121.

Figure 5:
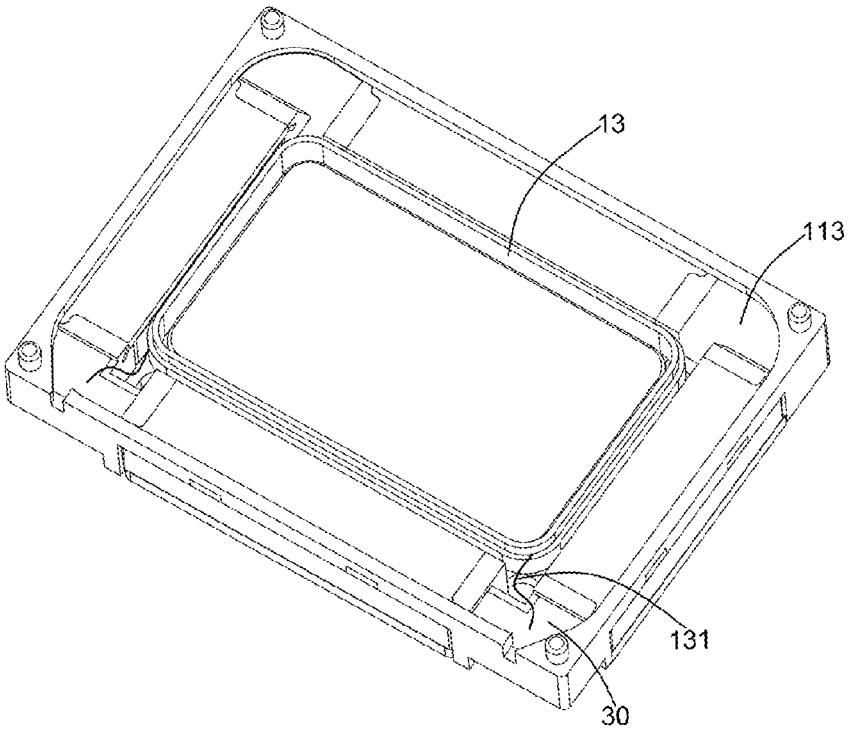
FIG. 5 is an isometric view of a micro-speaker in accordance with another embodiment.
Figure 6:
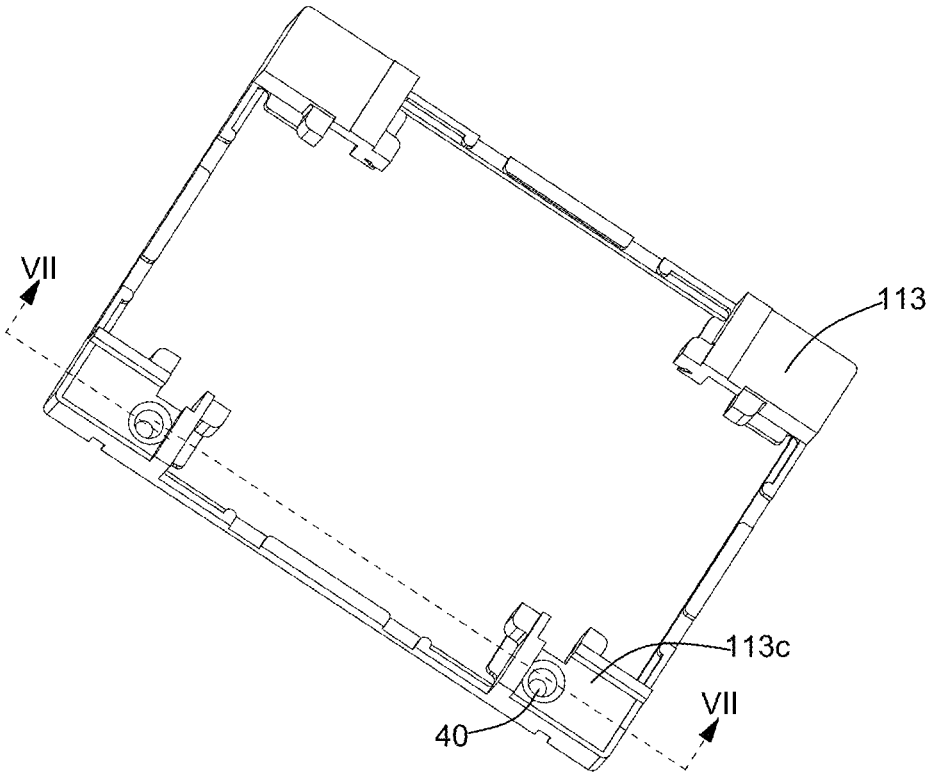
FIG. 6 is an isometric view of the micro-speaker in FIG. 5, from another aspect.
Figure 7:
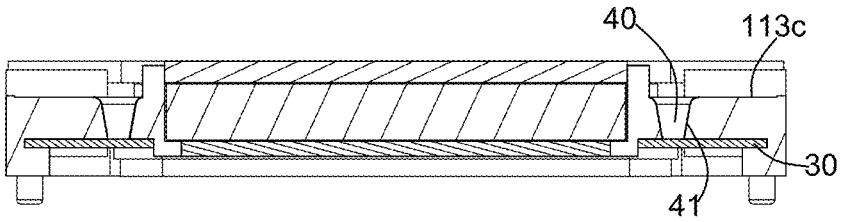
FIG. 7 is a cross-sectional view of the micro-speaker taken along line VII-VII in FIG. 6.

Referring to FIGS. 5-7, another embodiment of the present disclosure, a conductive plate 30 is arranged on the upper surface of the block 113, and the lead wire 131 of the voice coil 13 is electrically connected to the conductive plate 30. The bottom surface 113*c* of the block 113 is also treated by LDS process. For electrically connecting the conductive plate 30 and the bottom surface 113*c*, the block 113 further includes a through hole 40 having an inner surface 41 including a conductive layer. One end of the conductive layer connects to the conductive plate 30, and another end of the conductive layer connects to the bottom surface 113*c*, thereby electrically connecting the conductive plate 30 to the bottom surface 113*c*.

By virtue of the configuration described above, the space for receiving the magnetic circuit unit is ensured because no space is especially provided for the contacts. Meanwhile, the lead wire of the voice coil is stably fixed to the LDS area.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker, comprising:

a frame made of plastic and providing a cavity bounded by a sidewall, the frame further including a plurality of blocks extending from the sidewall into the cavity, the block including an upper surface, a side surface, and a bottom surface connecting to the upper surface via the side surface;

a magnetic circuit unit accommodated in the cavity and positioned by the blocks, the magnetic circuit unit having a magnetic gap;

a voice coil having lead wires and partially suspending in the magnetic gap, the lead wire of the voice coil connecting with the upper surface of the block;

a diaphragm facing the magnetic circuit unit and connected to the voice coil for radiating sounds; wherein the upper surface, the side surface and the bottom surface are electrically connected to each other by laser direct structuring process.

2. The micro-speaker as described in claim 1, wherein the upper surface, the side surface and the bottom surface are all treated by laser direct structuring process.

3. The micro-speaker as described in claim 1, wherein the bottom surface of the block is closer to the diaphragm than a bottom of the magnetic circuit unit.

4. The micro-speaker as described in claim 1, wherein the upper surface of the block is covered by a conductive plate, the bottom surface of the block is treated by laser direct structuring process, and the block further includes a through hole with an inner surface having conductive layer for electrically connecting the conductive plate to the bottom surface.

5. The micro-speaker as described in claim 1 further including a cover fixing the diaphragm to the frame.

* * * * *